US006138550A

United States Patent [19]

Fingar, Jr. et al.

[11] Patent Number: 6,138,550

[45] Date of Patent: Oct. 31, 2000

[54] PUMP DIAPHRAGM AND METHOD FOR MAKING THE SAME

[75] Inventors: Richard E. Fingar, Jr., Carol Stream; Michael J. Bender, Marengo, both of Ill.

[73] Assignee: Saint-Gobain Performance Plastics Corporation, Wayne, N.J.

[21] Appl. No.: 09/159,059

[22] Filed: Sep. 23, 1998

[51] Int. Cl.[7] ..... F16J 3/02

[52] U.S. Cl. ..... 92/103 R; 92/103 SD

[58] Field of Search ..... 92/103 R, 103 SD

[56] References Cited

U.S. PATENT DOCUMENTS

| | | | |
|---|---|---|---|
| 4,104,210 | 8/1978 | Coran et al. . | |
| 4,130,535 | 12/1978 | Coran et al. . | |
| 4,202,801 | 5/1980 | Petersen | 260/5 |
| 4,311,628 | 1/1982 | Abdou-Sabet et al. . | |
| 4,607,074 | 8/1986 | Hazelton et al. . | |
| 4,628,073 | 12/1986 | Fisher . | |
| 4,845,145 | 7/1989 | Hazelton et al. . | |
| 4,960,830 | 10/1990 | Hazelton et al. . | |
| 5,051,478 | 9/1991 | Puydak et al. . | |
| 5,073,597 | 12/1991 | Puydak et al. . | |
| 5,081,179 | 1/1992 | Sezaki et al. . | |
| 5,086,121 | 2/1992 | Hazelton et al. . | |
| 5,157,081 | 10/1992 | Puydak et al. . | |
| 5,217,797 | 6/1993 | Knox et al. . | |
| 5,349,896 | 9/1994 | Delaney, III et al. . | |
| 5,374,473 | 12/1994 | Knox et al. | 428/218 |
| 5,560,279 | 10/1996 | Connors et al. | 92/5 R |
| 5,615,597 | 4/1997 | Schoenmeyr | 92/103 SD |

OTHER PUBLICATIONS

*Chemlock 487A/B Material Safety Data Sheet*, published by Lord Chemical Products, pp. 1–7, Undated.

*Santoprene General Product Bulletin*, published by Advanced Elastomer Systems, pp. 1–10, Undated.

*Santoprene The Vulacanized Rubber that Processes as a Thermoplastic*, published by Advanced Elastomer Systems, pp. 1–5, Undated.

*Fluid Resistance of Santoprene Thermoplastic Rubber*, published by Advanced Elastomer Systems, pp. 1–11, Undated.

*Santoprene Thermoplastic Rubber*, Technical Bulletin, published by Advanced Elastomer Systems, pp. 3–18, Undated.

*Chemlock Product Information*, Undated.

*Flurocarbon Plastics, Materials in Design Engineering, Materials and Process Manual*, No. 215 pp. 93–104, Feb. 1964.

*Primary Examiner*—Edward K. Look
*Assistant Examiner*—Thomas E. Lazo
*Attorney, Agent, or Firm*—Sampson & Associates

[57] ABSTRACT

A composite pump diaphragm 10 includes a layer 12 fabricated from annealed polytetrafluoroethylene (PTFE) bonded to a layer 14 fabricated from an unreinforced thermoplastic elastomer including ethylene-propylene terpolymer (EPDM) and polypropylene. The diaphragm 10 is fabricated by chemically etching the PTFE layer 12, coating a surface thereof with a polyurethane adhesive, superimposing the layer 14 with layer 12 under heat and pressure, and allowing the superimposed layers to cure.

34 Claims, 1 Drawing Sheet

PUMP DIAPHRAGM AND METHOD FOR MAKING THE SAME

BACKGROUND OF THE INVENTION

1. Field of the Invention

This invention relates to diaphragms for use in pumps and valves, and more particularly to a diaphragm including a solid polytetrafluoroethylene layer adhered to a thermoplastic elastomeric layer.

2. Background Information

Diaphragm pumps are used in pumping a wide variety of materials especially when the materials are abrasive, have high viscosity, or consist of slurries that might damage other pump designs. These pumps are often air driven which is advantageous in pumping flammable liquids or in environments where electrically driven equipment could otherwise be hazardous. However, electrically or otherwise mechanically driven designs also find wide utility. Due to the wide nature of different materials these pumps are used to move, a correspondingly wide variety of materials are used in their construction. These include plastics and metals. For the same reason the critical driving member, i.e., the pump diaphragm, typically must be manufactured in a variety of materials.

Chemically resistant layers, such as those made of polytetrafluoroethylene (PTFE), are widely used in industry to protect sensitive parts of machinery or equipment from the corrosive effects of acids or other chemicals. One such use is in two piece pump diaphragms commonly used with air or electrically driven diaphragm pumps. In the two piece diaphragms, an outer PTFE overlay diaphragm is commonly used to protect an inner rubber diaphragm from materials that would cause rapid failure of the rubber part alone. In some other cases, the PTFE provides the sole material of construction of the diaphragm.

Such two piece diaphragms commonly utilize a PTFE layer and a thermoset material such as neoprene. While the PTFE layer tends to protect the diaphragm from corrosive effects of some materials, the thermoset rubber material is subject to failure due to other factors such as exposure to relatively low temperatures, tearing and abrasion. Moreover, conventional thermosetting elastomers may be relatively difficult and/or expensive to process, and provide inferior performance relative to thermoplastic elastomers or thermoplastic rubbers.

However, thermoplastic elastomers or rubbers tend to be difficult to bond to PTFE, and tend to delaminate when subjected to repeated flexure, such as experienced in pump diaphragm applications.

Thus, a need exists for a composite diaphragm and a method for making such a diaphragm, that utilizes a layer of PTFE bonded to a thermoplastic elastomer.

SUMMARY OF THE INVENTION

According to an embodiment of this invention, a method of fabricating a composite diaphragm includes the steps of:

(a) providing a first layer of polytetrafluoroethylene;

(b) annealing the first layer;

(c) chemically etching a surface of the first layer;

(d) applying an adhesive to the surface of the first layer;

(e) providing a second layer of a thermoplastic elastomer;

(f) placing the second layer in superposed engagement with the first layer, wherein the adhesive contacts both the first layer and the second layer;

(g) applying heat to the superposed first layer and second layer; and (h) applying pressure to the superposed first layer and second layer wherein the first layer is bonded to the second layer to form an integral composite diaphragm.

In a particular example of this aspect, the thermoplastic elastomer includes a blend of about 25 to 85 parts by weight of crystalline thermoplastic polyolefin resin and about 75 to about 15 parts by weight of vulcanized monoolefin copolymer rubber.

In another aspect of the present invention, a composite diaphragm includes a first layer of polytetrafluoroethylene; and a second layer of an unreinforced thermoplastic elastomeric blend of a thermoplastic material and a fully vulcanized thermoset elastomer.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
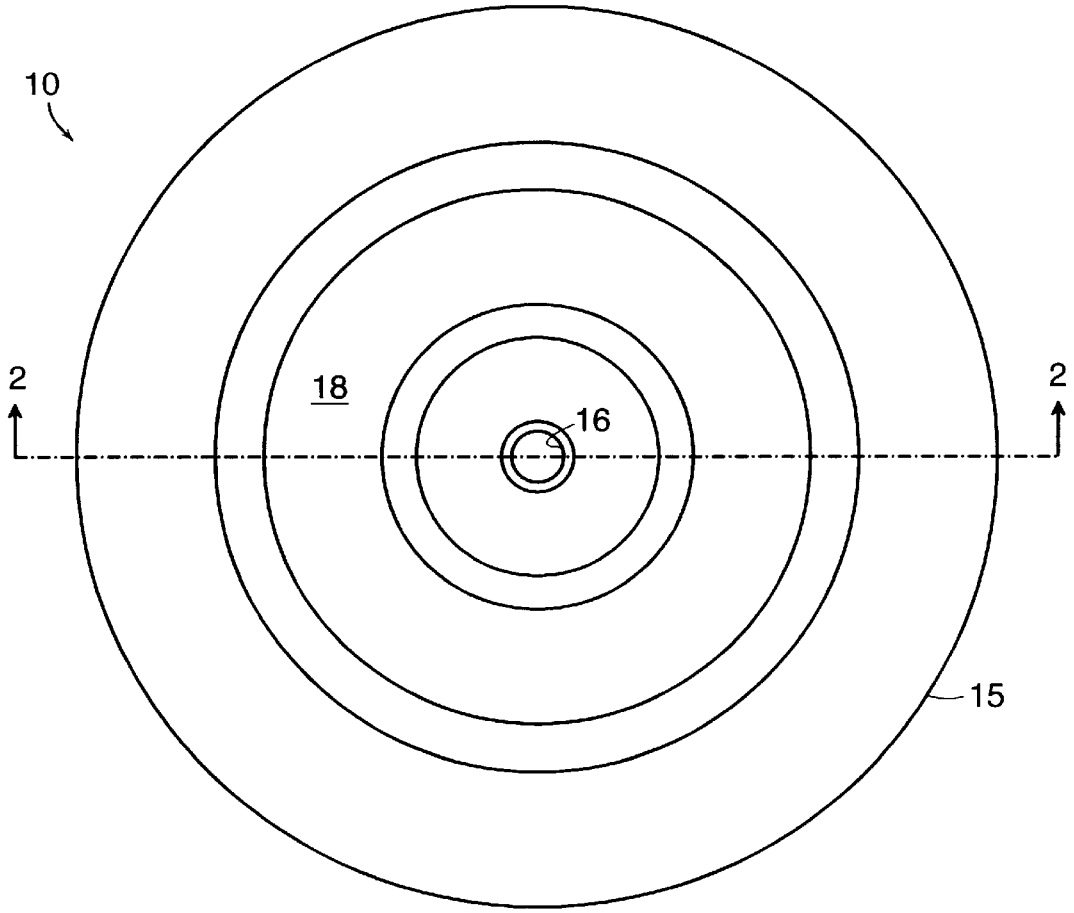
FIG. 1 is a plan view of a diaphragm of the subject invention.

Referring to the figures set forth in the accompanying Drawings, the illustrative embodiments of the present invention will be described in detail hereinbelow. For clarity of exposition, like features shown in the accompanying Drawings shall be indicated with like reference numerals.

Figure 2:
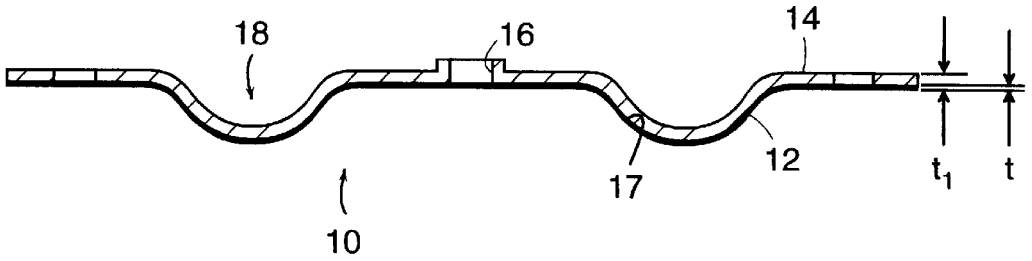
FIG. 2 is a cross-sectional view taken along 2—2 of FIG. 1.

As shown in FIGS. 1 and 2, the present invention is a composite pump diaphragm 10 including a layer 12 fabricated from polytetrafluoroethylene (PTFE) bonded to a layer 14 fabricated from a thermoplastic elastomer including ethylene-propylene terpolymer (EPDM) and polypropylene. The diaphragm 10 is fabricated by chemically etching the PTFE layer 12, coating a surface thereof with a bonding agent such as an adhesive sold under the trademark Chemlock® by Lord Corporation of Erie Pa.

Referring now to the drawings in detail, as shown in the Figs., diaphragm 10 is a generally disk shaped device which may be provided with substantially any geometry desired for particular pump applications. As shown in FIG. 1, the diaphragm has a substantially circular perimeter 15 of predetermined diameter, with a center hole 16 adapted for engagement with a central shaft of a pump (not shown). The diaphragm 10 also includes an annular, concavo-convex flexure or displacement portion 18 (FIGS. 1 and 2). This flexure portion 18 of the diaphragm is defined as that portion of the diaphragm that reciprocally flexes as the diaphragm is used. As shown, the surfaces of each layer 12 and 14 are substantially smooth, rather than being formed with annular or radial ribs as utilized in prior art diaphragms. Moreover, layers 12 and 14 are bonded directly to one another in surface to surface engagement without the use of intermediate reinforcing layers such as fabric and the like. The present invention thus utilizes substantially smooth, unreinforced layers of PTFE and thermoplastic elastomer, which are respectively bonded directly to one another in surface to surface engagement, as will be discussed in greater detail hereinbelow. As used herein, the term "smooth" as used in conjunction with a layer of material, means a layer which is not provided with either annular or radially extending ribs. Similarly, the term "unreinforced" as used herein refers to a layer of material which is neither reinforced by ribs, nor by a fabric or cloth material laminated thereto.

As shown in FIG. 2, diaphragm 10 includes a layer 12 of PTFE which is secured to a layer 14 of a thermoplastic elastomer. The PTFE layer 12 may be a layer of dense PTFE. Examples of full density PTFE include skived and sliced PTFE. The PTFE material provides the composite diaphragm with an inert outside surface to increase the durability and chemical resistance of the diaphragm 10. The solid PTFE layer has an inside surface 17 which is adhered to the thermoplastic elastomer layer 14. Prior to assembly onto layer 14, layer 12 is heat-treated or annealed by heating to its gel point (i.e. approximately 620–630 degrees F. (326–332 degrees C.)) followed by quenching. In a preferred embodiment layer 12 is heated to about 700–730 degrees F. (371–387 degrees C.) and then quenched in a chilled mold to resolidify the PTFE. The mold is sized and shaped to provide the layer 12 with its desired, predetermined geometry, including the concavo-convex displacement portion 18. Preferred quenching temperatures are in a range of between about 50–90 degrees F. (10–32 degrees C.). During this quenching operation, the mold applies a pressure of between about 250–750 psi (1.7–5.2 MPa). This annealing operation serves to modify the crystalline structure (i.e. reduce the crystallinity) of the PTFE to improve the flex life of layer 12.

As used herein, the term "anneal" is defined as any process capable of producing a directly or indirectly measurable reduction in crystallinity of PTFE layer 12, relative to untreated PTFE. One example of an indirect measure of crystallinity is measurement of specific gravity. The crystallinity of the PTFE layer is generally proportional to the specific gravity of the material. As the crystallinity and specific gravity are reduced, the flex life of the material improves. In a preferred embodiment, the annealed PTFE layer 12 of the present invention has a specific gravity equal to or less than about 2.15, as measured by ASTM test method D-792.

Although a preferred annealing process has been disclosed, any other process capable of reducing the crystallinity of PTFE layer 12 may be utilized. For example, various parameters of the annealing process disclosed herein including the rate at which the material is cooled after heating, and/or temperature and duration of the heating step, may be modified without departing from the spirit and scope of the present invention.

The inside surface 17 of layer 12 is then etched by a suitable chemical etchant to increase the surface energy of the PTFE and thereby increase its adherence to the layer 14. Examples of suitable etchants include alkali naphthanates or ammonianates such as sodium ammonianate and sodium napthalene. The ammonianates are preferred etchants for use in the present invention as they have been shown to provide a better bond than the napthanates.

After etching, a bonding agent is applied to the etched surface to the PTFE layer 12. A preferred bonding agent is a mixture of 2 weight percent of amino silane monomer in methyl isobutyl ketone (MIBK) such as sold under the trademark Chemlock® 487B by Lord Corporation of Erie, Pa.

Layer 14 may be substantially any thermoplastic elastomer, (thermoplastic rubber) such as styrene-butadiene block copolymers (YSBR), styrene-isoprene rubber (YSIR), vinylacetate-ethylene copolymers (YEAM), polyolefins (YEPM) and YAU, YEU and YACM. In a preferred embodiment, layer 14 is fabricated from a thermoplastic elastomeric blend of a thermoplastic material such as a thermoplastic polyolefin resin and a fully cured or vulcanized thermoset elastomer such as a vulcanized monoolefin co-polymer rubber. Such a material is disclosed in U.S. Pat. No. 4,130,535, which is fully incorporated by reference herein.

For example, the thermoplastic elastomer may include a blend of about 25 to 85 parts by weight of crystalline thermoplastic polyolefin resin and about 75 to about 15 parts by weight of vulcanized monoolefin copolymer rubber. In a more specific example, the resin is polypropylene and the rubber is EPDM rubber, in the proportions of about 25–75 parts by weight of polypropylene and about 75–25 parts by weight of EPDM rubber.

An example of such a thermoplastic rubber is a blend of EPDM (ethylene-propylene terpolymer) and a polypropylene sold under the trademark Santoprene® registered to Monsanto Company and exclusively licensed to Advanced Elastomer Systems, L. P., of St. Louis Mo. Santoprene® thermoplastic rubber is available in several grades ranging from a durometer or hardness of 55 Shore A to 50 Shore D, having flexural moduli ranging from between 7 and 350 MPa as set forth in a technical bulletin entitled Santoprene® Thermoplastic Rubber, published by Advanced Elastomer Systems, L. P. which also is fully incorporated by reference herein. Preferred grades of Santoprene® thermoplastic rubber for use in the present invention range from a durometer of 73 Shore A to 40 Shore D, having flexural moduli ranging from 24 to 140 MPa, respectively.

The thermoplastic layer 14 is mated in a superimposed manner with the etched and adhesive coated inside surface 17 of PTFE layer 12. Heat and pressure are then applied to the superimposed layers 12 and 14 to bond the layers to one another. The layers are preferably heated to a temperature which is near or within the conventional melt processing range of the layer 14 to facilitate forming and bonding of the material. For example, where a Santoprene® thermoplastic rubber having a melt processing temperature of about 380 degrees F. (193 degrees C.) is used, the layers 12 and 14 are heated to a temperature of approximately 375 to 385 degrees F. (190 degrees C. to 196 degrees C.) under pressure of approximately 250–500 psi (1.7–35 MPa).

The application of heat and pressure may be accomplished by clamping the layers between heated platens of a clamp or press. In a similar alternative, the layers may be heated followed by compression in an unheated clamp or press.

Moreover, in a preferred embodiment, layer 14 may be formed by injection molding the thermoplastic rubber onto the etched and adhesive coated PTFE layer 12. This approach is particularly advantageous as it tends to provide a laminant of consistent quality nominally without air bubbles which are generally problematic in other heat/pressure formed laminates. The present invention facilitates use of this injection molding technique by its lack of fabric or similar reinforcements, since such reinforcement tends to complicate the injection molding process.

As shown, the completed diaphragm 10 may be provided with any suitable physical dimensions, with PTFE layer 12 having a thickness t (FIG. 2) and thermoplastic layer 14 having a thickness t1. Diaphragms 10 formed as described hereinabove have been shown to be resistant to cracking and delamination to provide a useful life which is superior to similar prior art devices. This superior useful life is surprising since PTFE has been known to crack and fail in prior art diaphragms used in pumping applications. This superior life is particularly surprising since the PTFE layer 12 of the present invention has substantially smooth surfaces, as discussed hereinabove, without having any radially or concentrically oriented ribs or other reinforcement as taught in the prior art. These advantages appear to be imparted by annealing (i.e. reducing the crystallinity of) the PTFE prior to lamination with layer 14. Moreover, it has been found that stresses generated during flexing of conventional reinforced diaphragms tend to concentrate at the reinforcements (i.e. fibers and/or ribs), leading to stress fractures and ultimate failure of these diaphragms. Contrariwise, the present invention reduces such stress concentrations by use of the aforementioned smooth layers to effectively distribute the stresses generated by diaphragm flexure for improved flex life. Additional factors which appear to contribute to the long useful life of the present invention include the elasticity of the thermoplastic elastomer, and the bond achieved by use of the ammonianate etchant. The improved consistency provided by the injection molding process also appears to advantageously affect the useful life of the diaphragm 10.

The following illustrative examples are intended to demonstrate certain aspects of the present invention. It is to be understood that these examples should not be construed as limiting.

EXAMPLES

Example 1

A diaphragm 10 was fabricated substantially as shown in FIGS. 1 and 2, with a perimeter 15 having a diameter of 7.75 inches (20 cm), a PTFE layer 12 having a thickness t within a range of about 0.030 to 0.060 inches (0.07 to 0.15 cm) and a Santoprene® thermoplastic rubber layer 14 having a thickness t1 of 0.130 inches (0.33 cm). The PTFE layer 12 was heated to 700 degrees F. (371 degrees C.) until fully gelled and then quenched in a mold at 65 degrees F. (18 degrees C.) and 300 psi (2.0MPa). The layer 12 was then etched and coated with Chemlock 487B and mated with layer 14. The layers 12 and 14 were heated to 350 to 400 degrees F. (176–204 degrees C.), maintained at this temperature for between 2 and 10 minutes, and compressed at between 500–750 psi (3.4 and 5.2 MPa). The diaphragm was then allowed to cure at ambient temperature for 24 hours. The resulting diaphragm 10 was tested in a pumping application in which water within a range of from 105 to 112 degrees F. was pumped at between 96 and 102 psi (0.66 and 0.70 Mpa) at a cycle rate of 340 to 375 cycles per minute. The diaphragm operated for 25 million cycles with no rupture of the PTFE layer.

Example 2 (Control)

Four diaphragms were fabricated with a layer of elastomeric material other than Santoprene® with a PTFE layer mechanically fastened thereto. These samples were tested in the manner described in Example 1. All of the diaphragms failed at between 8,000,000 and 9,000,000 cycles.

Example 3

A diaphragm 10 was fabricated substantially as shown in FIGS. 1 and 2, with perimeter 17 having a diameter of approximately 8.125 inches (20.6 cm), PTFE layer 12 having a thickness t of 0.030 inches (0.07 cm), and Santoprene® layer 14 having a thickness of 0.110 inches (0.28 cm). The PTFE layer 12 was heated to gel and then quenched in the manner described in Example 1. It was then etched with sodium ammonianate and coated with Chemlock 487B. A layer 14 was then injection molded onto layer 12 at a temperature within a range of about 375 to 385 degrees F. (190 degrees C. to 196 degrees C.) at a conventional injection molding pressure. The layers were cured at ambient temperature for 24 hours. This diaphragm was tested in actual pumping conditions substantially as described in Example 1 and completed 30 million cycles without rupture of the PTFE layer.

Example 4

Four diaphragms were fabricated substantially as described in Example 3, utilizing black and naturally pigmented Santoprene® materials of Shore 73A, 80A and 87A hardnesses (i.e. Santoprene® 101-73A, 101-80A, 101-87A, 201-73A, 201-80A and 201-87A, respectively). These diaphragms were tested in actual pumping conditions substantially as described in Example 1 and completed at least 25,000,000 cycles without rupture of the PTFE layer.

Example 5

Two diaphragms 10 were fabricated substantially as described in Example 3, with a layer 14 fabricated from Santoprene® 203-40D (naturally pigmented with a hardness of 40 Shore D) and 271-40D (food grade material with a hardness of 40 Shore D). These diaphragms were tested in actual pumping conditions substantially as described in Example 1 and completed at least 20,000,000 cycles with no rupture of the PTFE layer.

Example 6

A diaphragm 10 is fabricated substantially as described in Example 3 with a perimeter 17 having a diameter of approximately 12 inches (30.5 cm). This diaphragm is expected to complete at least 20,000,000 cycles in actual pumping conditions without rupture of the PTFE layer.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A method of fabricating a composite diaphragm comprising the steps of:

(a) providing a first layer of polytetrafluoroethylene;

(b) annealing the first layer by heating the first layer to its gel point and then quenching the first layer;

(c) etching a surface of the first layer;

(d) applying an adhesive to the surface of the first layer;

(e) providing a second layer of a thermoplastic elastomer;

(f) disposing the second layer in superposed engagement with the first layer, wherein the adhesive contacts both the first layer and the second layer;

(g) applying heat to the superposed first layer and second layer; and (h) applying pressure to the superposed first layer and second layer wherein the first layer is bonded to the second layer to form an integral composite diaphragm.

2. The method of claim 1, wherein the first layer has a specific gravity less than or equal to 2.15.

3. The method of claim 1, wherein the second layer is substantially smooth.

4. The method of claim 1, where said steps (e) and (f) further comprise the steps of injection molding the second layer onto the first layer.

5. The method of claim 1, wherein the thermoplastic elastomer comprises a blend of a thermoplastic material and a fully vulcanized thermoset elastomer.

6. The method of claim 5, wherein the thermoplastic elastomer further comprises a blend of about 25 to 85 parts by weight of crystalline thermoplastic polyolefin resin and about 75 to about 15 parts by weight of vulcanized monoolefin copolymer rubber.

7. The method of claim 6, wherein the resin is polypropylene and the rubber is EPDM rubber, in the proportions of about 25–75 parts by weight of polypropylene and about 75–25 parts by weight of EPDM rubber.

8. The method of claim 1, wherein the thermoplastic elastomer has a durometer within a range of from 55 Shore A to 50 Shore D.

9. The method of claim 8, wherein the thermoplastic elastomer has a durometer within a range of from 73 Shore A to 40 Shore D.

10. The method of claim 1, wherein said heating step (j) further comprises heating the first layer to a temperature of at least substantially 620 degrees F. (326 degrees C.).

11. The method of claim 10, wherein said heating step (j) further comprises heating the first layer to 700 degrees F. (371 degrees C.).

12. The method claim 1, wherein said quenching step (k) further comprises the step of quenching the first layer at a temperature within a range of 50–90 degrees F. (10–32 degrees C.).

13. The method of claim 1, wherein said quenching step (k) further comprises the step of molding the first layer.

14. The method of claim 1, wherein said quenching step (k) further comprises the step of molding the first layer in a mold disposed at a quenching temperature, at a pressure within a range of 1.7 to 5.2 MPa.

15. The method of claim 1, wherein the adhesive comprises a composition of about 2 weight percent of amino silane monomer and about 98 weight percent methyl isobutyl ketone.

16. The method of claim 1, wherein said chemically etching step (c) further comprises applying an alkali ammonianate to the surface of said PTFE layer.

17. The method of claim 16, wherein the alkali ammonianate comprises sodium ammonianate.

18. A composite diaphragm comprising:

a first layer of annealed polytetrafluoroethylene, having been annealed by heating to its gel temperature in a mold, and quenching; and a second layer of an unreinforced thermoplastic elastomeric blend of a thermoplastic material and a fully vulcanized thermoset elastomer.

19. The composite diaphragm of claim 18, wherein said first layer has a specific gravity less than or equal to 2.15.

20. The composite diaphragm of claim 18, wherein said first layer is annealed by heating to a temperature within a range of from about 326 degrees C. to 387 degrees C.

21. The composite diaphragm of claim 18, wherein said thermoplastic elastomeric blend further comprises a blend of about 25 to 85 parts by weight of crystalline thermoplastic polyolefin resin and about 75 to about 15 parts by weight of vulcanized monoolefin copolymer rubber.

22. The composite diaphragm of claim 21, wherein said resin is polypropylene and said rubber is EPDM rubber, in the proportions of about 25–75 parts by weight of polypropylene and about 75–25 parts by weight of EPDM rubber.

23. The composite diaphragm of claim 18, wherein said hermoplastic elastomeric blend has a durometer within a ange of from 55 Shore A to 50 Shore D.

24. The composite diaphragm of claim 23, wherein said thermoplastic elastomeric blend has a durometer within a range of from 73 Shore A to 40 Shore D.

25. The composite diaphragm of claim 18, wherein said second layer is injection molded onto said first layer.

26. The composite diaphragm of claim 18, wherein said first layer and said second layer are bonded to one another by an adhesive.

27. The composite diaphragm of claim 26, wherein said adhesive further comprises a composition of about 2 weight percent of amino silane monomer and about 98 weight percent methyl isobutyl ketone.

28. The composite diaphragm of claim 18, wherein said first layer is etched with an ammonianate etchant.

29. A composite diaphragm formed by the process of:

(a) providing a first layer of polytetrafluoroethylene;

(b) annealing the first layer by heating the first layer to its gel point and then quenching the first layer;

(c) chemically etching a surface of said first layer;

(d) applying an adhesive to the surface of said first layer;

(e) providing a second layer of an unreinforced thermoplastic elastomer;

(f) disposing said second layer in superposed engagement with said first layer;

(g) applying heat to said superposed first layer and second layer; and (h) applying pressure to said superposed first layer and second layer, wherein said first layer is bonded to said second layer to form an integral composite diaphragm.

30. A composite diaphragm comprising:

a first layer of polytetrafluoroethylene; and a second layer of an unreinforced thermoplastic elastomeric blend of about 51 to 85 parts by weight of crystalline thermoplastic polyolefin resin and about 49 to about 15 parts by weight of vulcanized monoolefin copolymer rubber.

31. A composite diaphragm comprising:

a first layer of polytetrafluoroethylene;

a second layer of an unreinforced thermoplastic elastomeric blend of a thermoplastic material and a fully vulcanized thermoset elastomer;

said first layer and said second layer being bonded to one another by an adhesive including a composition of about 2 weight percent of amino silane monomer and about 98 weight percent methyl isobutyl ketone.

32. A composite diaphragm comprising:

a first layer of etched polytetrafluoroethylene, having been etched with an ammonianate etchant; and a second layer of an unreinforced thermoplastic elastomeric blend of a thermoplastic material and a fully vulcanized thermoset elastomer.

33. A method of fabricating a composite diaphragm comprising the steps of:

(a) providing a first layer of polytetrafluoroethylene;

(b) annealing the first layer;

(c) chemically etching a surface of the first layer;

(d) applying an adhesive to the surface of the first layer, the adhesive including a composition of about 2 weight percent of amino silane monomer and about 98 weight percent methyl isobutyl ketone;

(e) providing a second layer of a thermoplastic elastomer;

(f) disposing the second layer in superposed engagement with the first layer, wherein the adhesive contacts both the first layer and the second layer;

(g) applying heat to the superposed first layer and second layer; and (h) applying pressure to the superposed first layer and second layer wherein the first layer is bonded to the second layer to form an integral composite diaphragm.

34. A method of fabricating a composite diaphragm comprising the steps of:

(a) providing a first layer of polytetrafluoroethylene;

(b) annealing the first layer;

(c) chemically etching a surface of the first layer by applying an ammonianate etchant to the surface of said PTFE layer;

(d) applying an adhesive to the surface of the first layer;

(e) providing a second layer of a thermoplastic elastomer;

(f) disposing the second layer in superposed engagement with the first layer, wherein the adhesive contacts both the first layer and the second layer;

(g) applying heat to the superposed first layer and second layer; and (h) applying pressure to the superposed first layer and second layer wherein the first layer is bonded to the second layer to form an integral composite diaphragm.

* * * * *